US006170824B1

(12) United States Patent
Kaplan

(10) Patent No.: US 6,170,824 B1
(45) Date of Patent: Jan. 9, 2001

(54) CORPORATE AUTHORITY: A BOARD GAME ABOUT THE RANK AND ORDER STRUCTURE OF CORPORATE JOB TITLE AND THE CONSEQUENCES OF TWO SEPARATE COMPANIES MERGING

(76) Inventor: Bernard Kaplan, 41-07 Bowne St., Flushing, NY (US) 11355

( * ) Notice: Under 35 U.S.C. 154(b), the term of this patent shall be extended for 0 days.

(21) Appl. No.: 09/488,250

(22) Filed: Jan. 20, 2000

(51) Int. Cl.[7] ..... A63F 3/00
(52) U.S. Cl. ..... 273/236; 273/278; 273/256
(58) Field of Search ..... 473/236; 273/236, 273/146, 256, 278

(56) References Cited

U.S. PATENT DOCUMENTS

D. 106,967 * 11/1937 Danon ..... 273/236
D. 112,805 * 1/1939 Bratt ..... 273/236
3,895,805 * 7/1975 Enos ..... 273/135 F
3,901,513 * 8/1975 Spohn ..... 273/135 R
4,095,799 * 6/1978 Stringer ..... 273/241
4,323,248 * 4/1982 Zingale ..... 273/236
4,846,479 * 7/1989 Hanley ..... 273/236
5,129,649 * 7/1992 Scholz ..... 273/236
5,167,503 * 12/1992 Jordan ..... 434/128
5,415,413 * 5/1995 Morinich ..... 273/271
5,839,725 * 11/1998 Conway ..... 273/244
6,045,128 * 4/2000 Hunt ..... 273/236

* cited by examiner

*Primary Examiner*—Jeanette Chapman
*Assistant Examiner*—Dolores R. Collins

(57) ABSTRACT

This invention is a two-player, hide and attack, scavenger hunt strategy board game that is a hybrid combination of Checkers, Chess, Stratego and Life. This board game allows each player to have the ability of making, naming, and drawing their own game piece that they would like to see included in a corporate workplace. This part of the game adds control as well as creativity for both of the players involved in the board game. Another aspect of this board game is the structure and function of the game pieces themselves in which the brief case game pieces have the option of not only being hidden from the players opponent but from the player themselves. Other structures and functions of this board game include an educated guessing game piece, a moving continuously changing game piece that changes temporarily to a different game piece every time it is attacked or does the attacking, a transferable game piece, and a game piece that must be attacked more then once to be put out of play. In addition, this game has some human resource obstacle pieces such as the hired, fired/laid off, rehired, promoted, transferred and demoted pieces. The object of the game is for each player to apprehend the card key first, locate the corporate elevator second, and find the corporate merger contract third; to win the game; keep their job and take control of the merging company.

3 Claims, 8 Drawing Sheets

CORPORATE AUTHORITY: A BOARD GAME ABOUT THE RANK AND ORDER STRUCTURE OF CORPORATE JOB TITLE AND THE CONSEQUENCES OF TWO SEPARATE COMPANIES MERGING

FIELD OF THE INVENTION

This invention generally relates to board games with unique game pieces that combine the skills of memorization, creativity, imagination, bravery, cautiousness, decision-making, critical thin king, spontaneousness, awareness, educated guessing, discretion and clever deception strategies in a corporate environment. The Corporate Authority board game is about a power struggle rivalry between two separate companies about to merge in which they settle their differences through job position title ranking. This board game relates to such games as Chess, Stratego, Checkers, and Life.

BACKGROUND OF THE INVENTION

The first aspect of how the Corporate Authority board game is different from both Chess and Stratego is that this board game allows each player to make, name and draw out their own corporate game piece to their own specifications and limitations. This particular game piece in the corporate environment is called a ringer. Unlike, Chess and Stratego, where their game pieces are fixed and they leave no room for creating, naming and drawing a game piece; the Corporate Authority board game solves this problem by letting each player make up, name and draw their own game piece. Hence, let it be known there is a need for a game that helps a person bring out their creative and artistic side in him or her by giving them the ability to make, name and draw their own corporate game piece; and set the specifications and limitations of the game piece they just created. Let it also be known that in some unique instances after the game has started the person's opponent can make up, name, and draw a game piece for the opposing player.

In addition unlike Chess and Stratego this game has a game piece that allows each player to transfer their opponent's game piece to the opposing player's side; thus using the opponent's own game piece against him or herself. The Corporate Authority board game is also different from Chess and Stratego because it has a continuously changing people game piece. In which this game piece temporarily changes to a different people piece every time it is attacked or is doing the attacking. The way to find out what piece it's acting out as, at a given point in time, is to spin the wheel that's included in the game. Another facet that separates this game from other board games is that it has a game piece that must be hit twice by a specified rank or above.

Furthermore, another feature that differs from Chess and Stratego is that unlike both Chess and Stratego games where both board games have all their game pieces set at the beginning of the game; the Corporate Authority does not have all its game pieces set up in the beginning of the game. The Corporate Authority game has one piece that could come into play at any anytime during the game called the brown noser piece. The brown noser piece can only come into play if a player can guess what two consecutive pieces of his or her opponent he will put out of play next.

Also, the Corporate Authority board game in contrast to Chess and Stratego where your battlefield pertains to either a royalty environment (king, queens, etc) and/or the military environment; (generals, majors, etc) this game pertains to what happens when there is a merger in a corporate environment.

Another facet of why the Corporate Authority is different from Checkers, Chess and Stratego is the structure and meaning of the game pieces themselves. In Checkers, the game pieces all look the same (from top to bottom and side to side); they all have the same amount of power; and they all (the game pieces) are not hidden from their opponents. In Chess the game pieces don't look the same; don't have the same amount of power; and are not hidden from their opponent. In Stratego, the game pieces all look the same from the opponents view but not the players view. Also, in the game of Stratego the game pieces are not equal in power and can only be partially hidden; so the players can see their game pieces but the opponent can't see the opposing players game pieces. Whereas, in the Corporate Authority board game the game pieces have a choice to look the same from the player's and the opponent's view as well as look different from the players to the opponents view. The game pieces powers are not equal in the Corporate Authority and unlike Stratego; the Corporate Authority's game pieces can be completely hidden if both players choose to play in this fashion (forcing both players to activate and increase their memorizing capabilities).

Other unique attributes of this game that should be mention are game pieces that resemble the unemployed, game pieces that resemble government officials and game pieces that resemble human resource obstacles (hired piece, fired/laid off piece, transferred piece, rehired piece, human resources mystery piece, demoted piece and promoted piece).

Last, but not least, unlike Chess or Stratego where a player has to capture just one object to win the game, in the Corporate Authority game a player must capture three items (non-movable and movable) in a specified order to win the game. The Corporate Authority board game is not just about winning, it's also about keeping your job; and taking control of a merging company.

Another board game that should be discussed about that relates to the Corporate Authority board game is the board game called Life. The board game called Life deals with generally life's ups and downs like getting married, starting a family, or buying a house in which each player's goal is to dodge bad luck and make the most money. Whereas, the Corporate Authority board game deals with a specific part of a person's life; in particular their jobs. Another board game that may relate to the corporate authority is called Checkers. In the game of Checkers each game piece starts out as equals. Whereas, in the board game of the Corporate Authority each game piece does not start out as equals.

In conclusion, the Corporate Authority board game contributes to a both a child as well as an adult's skills and ability to think, debate, reason, arbitrate, memorize, comprehend, analyze, synthesize, evaluate, decision make and imagine.

BRIEF SUMMARY OF THE INVENTION

The Corporate Authority board game is a two-player hide and go seek, attack, scavenger hunt, corporate strategy game in which each player must cleverly arranges their game pieces and make up a skillful corporate battle plan that involves such talents as creativity, decision-making, awareness, bravery, cautiousness, spontaneousness, critical thinking, memorization, imagination, discretion, educated guessing and clever deception. This board game comprises of a horizontal playing surface of one hundred and fifty rectangular spaces with glow in the dark plastic miniature brief case game pieces. Each miniature brief case game piece is hidden from the opposing player and is composed of many different distinguishing people involved inside and outside the corporate work world. If both players choose to; they can also test their memorization skills by hiding the game pieces from themselves (by closing the brief cases) after they cleverly arrange the game pieces.

The unique aspects in this board game invention involve its game pieces. The most creative game piece involved in the game is the game piece that allows each player to make-up, draw and name a game piece by him or herself. There are also other make-up, draw and name pieces involved in this game that your opponent creates for their opposing player. The second unique game piece involved in this game is a game piece that can be transferred over from the original player to their opponent side; thus using the player's own original game piece against him or herself. A third unique game piece that is included in this game is a game piece of chance, in which the game piece has the ability to continuously change temporarily; if it is attacked, or doing the attacking. A fourth unique game piece in this board game that is used; is the concept of a new game piece that is introduced, after the official game has started; by the process of educated guessing. In addition, to the unique game pieces just mention there are also game pieces that must be hit twice by a specified rank or above for the game piece to be put out of play. Last, but not least, there are game pieces that can either improve or demote a game piece's rank.

Game pieces used in this board game are the CEO, president, vice president, director, manager, supervisor, sales, computer guru, secretaries/operators, mailroom clerks, cleaners/janitors, government officials, brown noser, private eye hacker, security, unemployed, human resources mystery piece, hired, fired/laid off, transferred, rehired, demoted, promoted, card key, corporate elevator, and corporate merger contract located in the executive conference room (all game pieces glow in the dark).

The Corporate Authority board game is based on a per turn basis in which each player has one chance to move per turn. When a player moves into their competitor's rectangular space a corporate confrontation begins. When a player is one space away from their opponent they have the option to touch their opponents game piece and declare job titles to see who is of higher rank in the corporate office. The higher job position wins and the lower job position goes out of play. Having a corporate clash is "optional"; the attacking player has a choice not to have corporate conflict. Ties of pieces result in both players still surviving and sharing corporate space together The object of this board game (The Corporate Authority) is for each player to collect their opponent's card key, find the corporate elevator and locate the corporate merger contract to win the game; keep their job and take control of the merging company.

BRIEF DESCRIPTION OF THE DRAWINGS

The accompanying drawings further describe this invention.

FIGS. 1, 3–28 are all perspective views of opened brief case game pieces.

Figure 1:
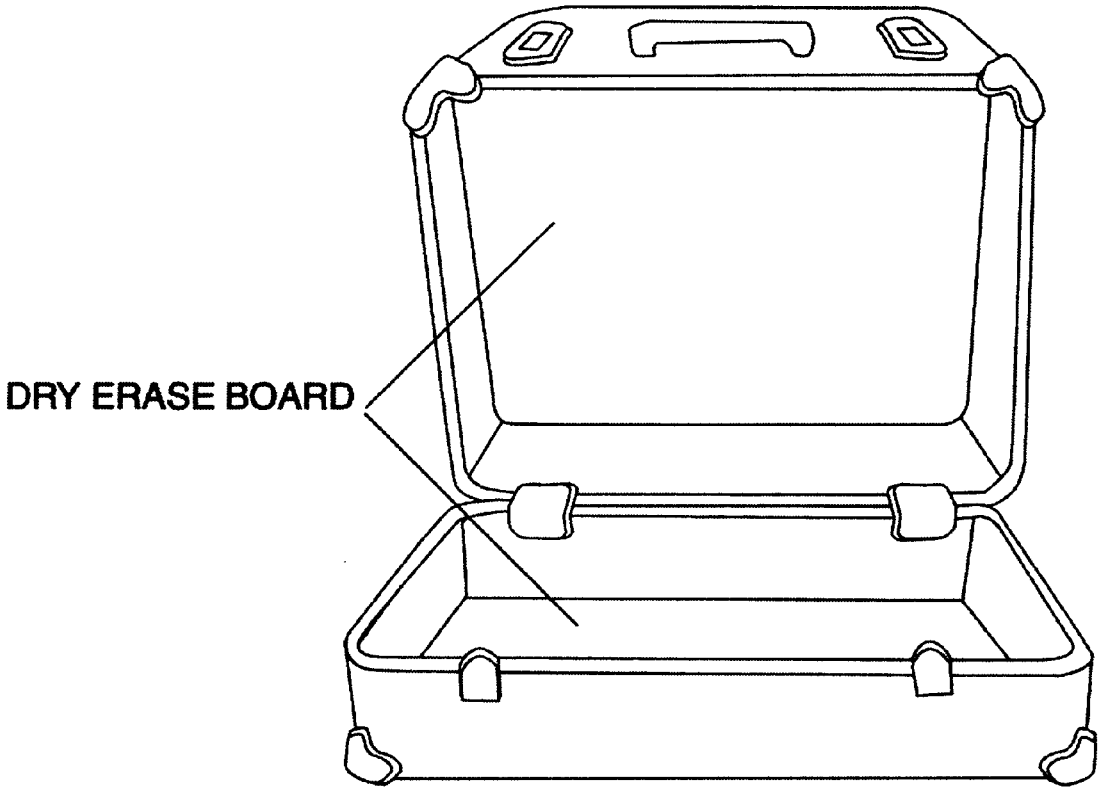
FIG. 1 is a perspective view of creating your own game piece. The create your own game piece has a dry eraser board attached inside the brief case game piece for the players to draw on it and make it any character they would like to see in the corporate environment (please note that the make, name and draw your own game piece can be called a ringer as well).
Figure 2:
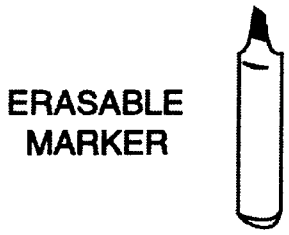
FIG. 2 is a perspective view of an erasable marker to be used on the make, name and draw your own corporate game piece.
Figure 3:
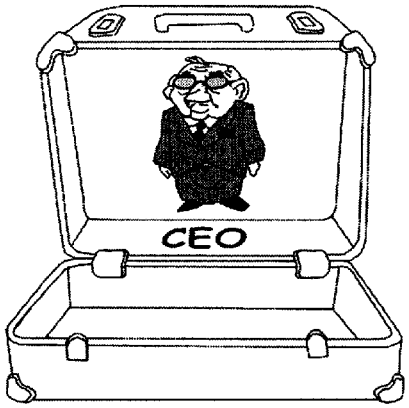
FIG. 3 is a perspective view of the CEO brief case game piece.
Figure 6:
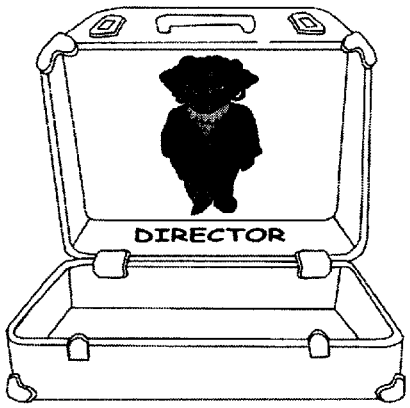
FIG. 6 is a perspective view of the director brief case game piece.
Figure 4:
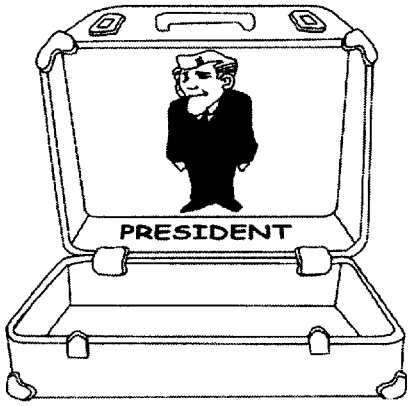
FIG. 4 is a perspective view of the president brief case game piece.
Figure 7:
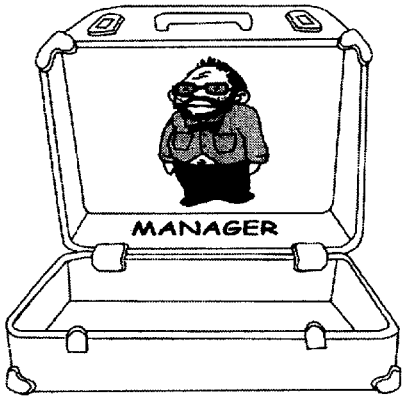
FIG. 7 is a perspective view of the manager brief case game piece.
Figure 5:
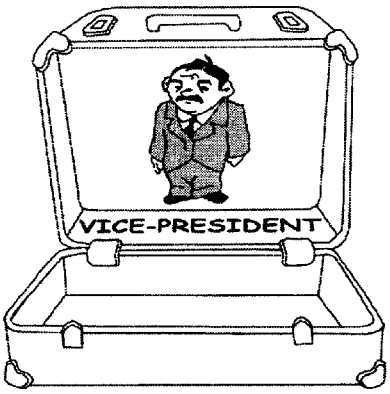
FIG. 5 is a perspective view of the vice-president brief case game piece.
Figure 8:
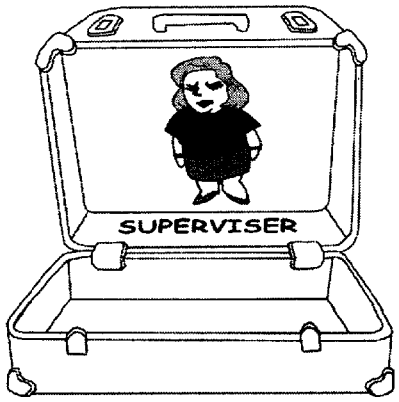
FIG. 8 is a perspective view of the supervisor brief case game piece.
Figure 9:
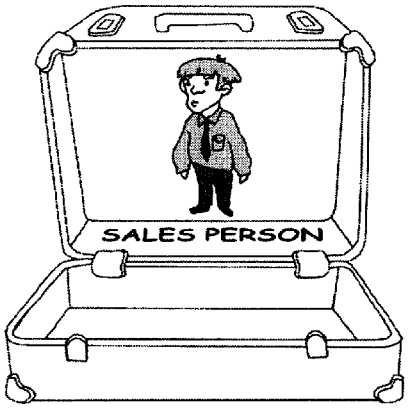
FIG. 9 is a perspective view of the sales person brief case game piece.
Figure 12:
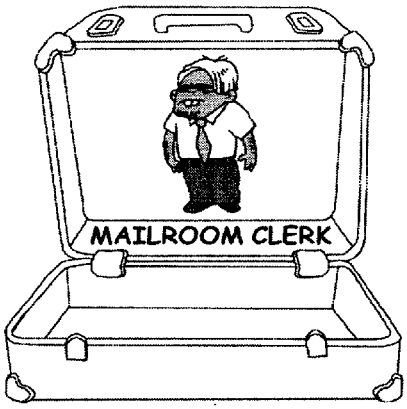
FIG. 12 is a perspective view of the mailroom clerk brief case game piece.
Figure 10:
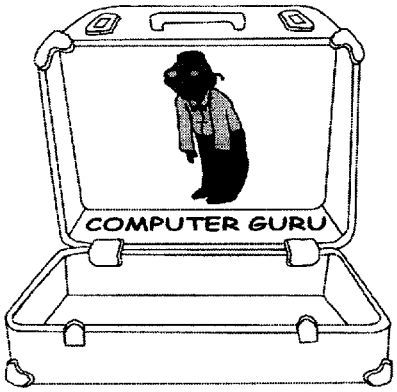
FIG. 10 is a perspective view of the computer guru brief case game piece.
Figure 13:
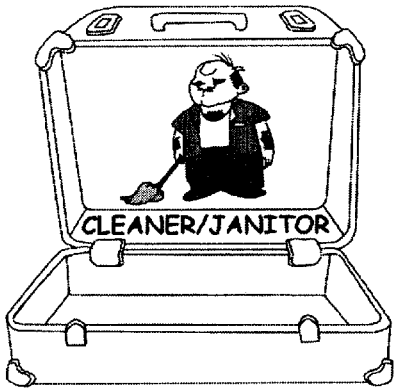
FIG. 13 is a perspective view of the cleaner/janitor brief case game piece.
Figure 11:
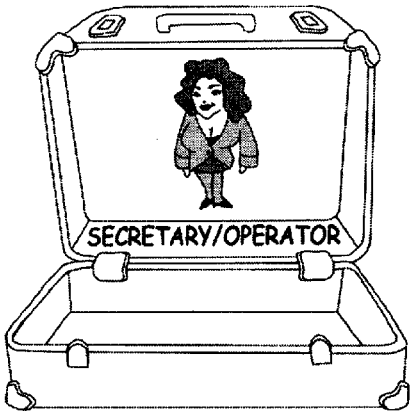
FIG. 11 is a perspective view of the secretary/operator brief case game piece.
Figure 14:
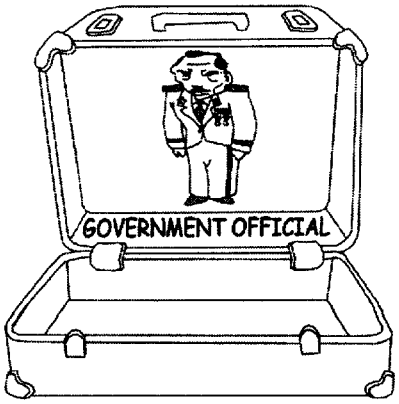
FIG. 14 is a perspective view of the government official brief case game piece.
Figure 15:
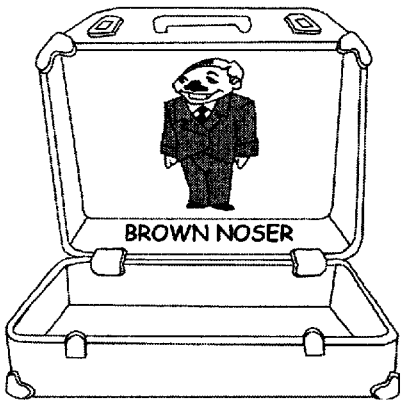
FIG. 15 is a perspective view of the brown noser brief case game piece.
Figure 16:
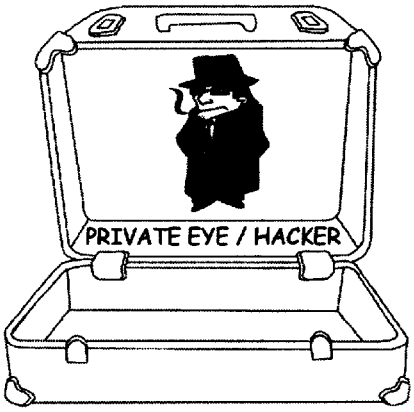
FIG. 16 is a perspective view of the private eye hacker brief case game piece.
Figure 17:
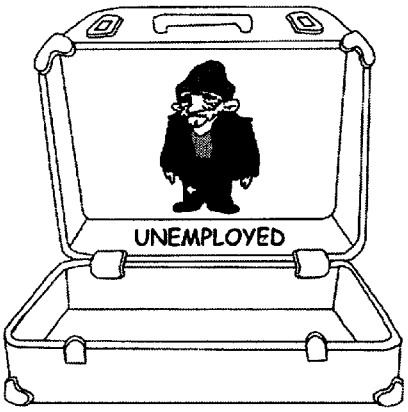
FIG. 17 is a perspective view of the unemployed brief case game piece.
Figure 18:
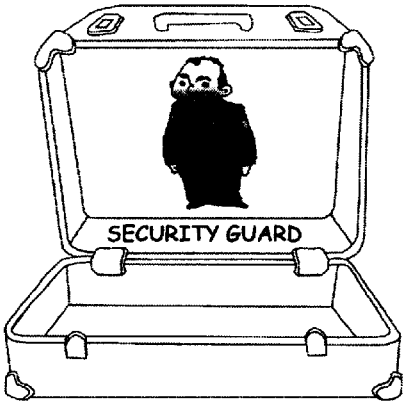
FIG. 18 is a perspective view of the security guard brief case game piece.
Figure 19:
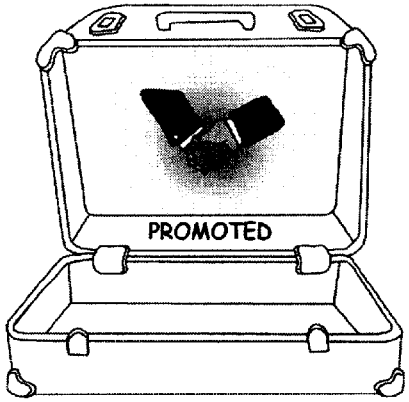
FIG. 19 is a perspective view of the promoted brief case game piece.
Figure 20:
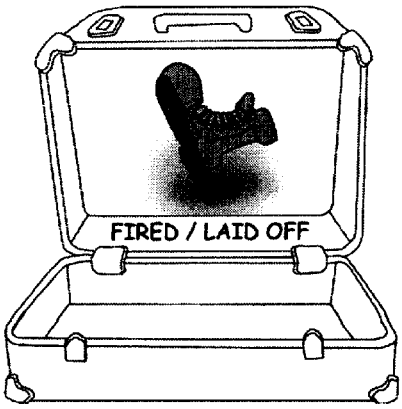
FIG. 20 is a perspective view of the fired/laid off brief case game piece.
Figure 21:
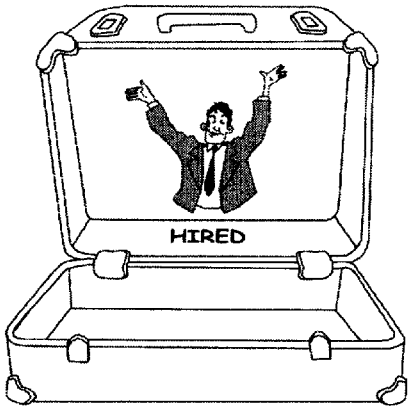
FIG. 21 is a perspective view of the hired brief case game piece.
Figure 22:
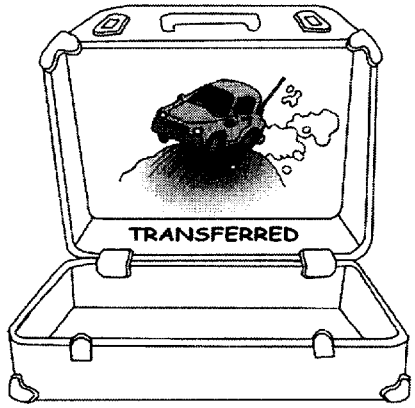
FIG. 22 is a perspective view of the transferred brief case game piece.
Figure 23:
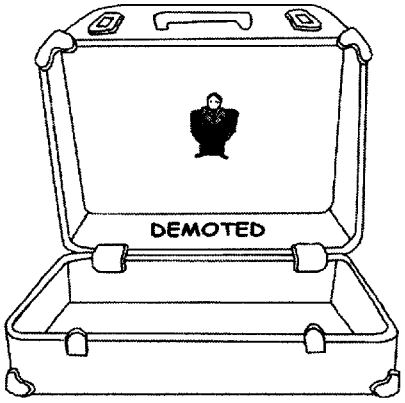
FIG. 23 is a perspective view of the demoted brief case game piece.
Figure 24:
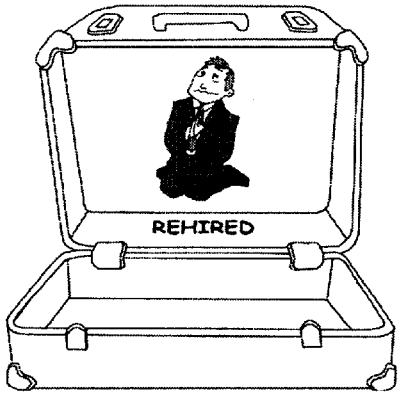
FIG. 24 is a perspective view of the rehired brief case game piece.
Figure 25:
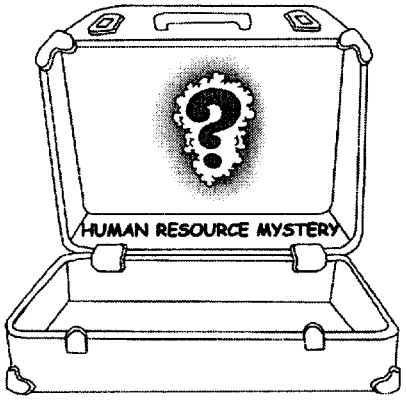
FIG. 25 is a perspective view of the human resource mystery brief case game piece.
Figure 26:
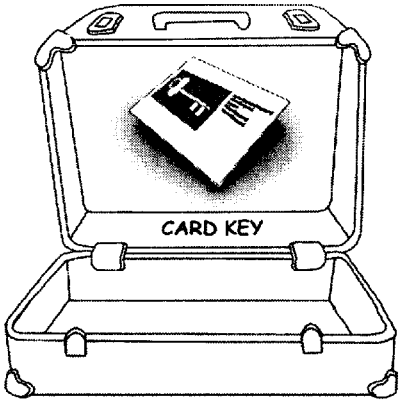
FIG. 26 is a perspective view of the card key brief case game piece.
Figure 27:
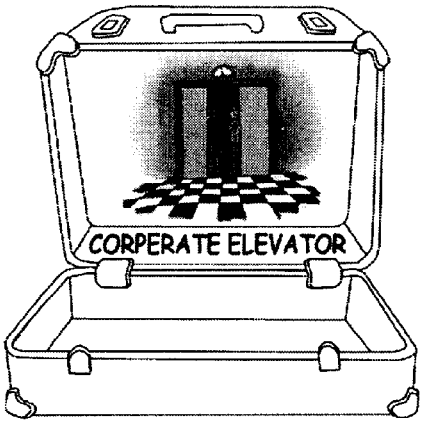
FIG. 27 is a perspective view of the corporate elevator brief case game piece.
Figure 30:
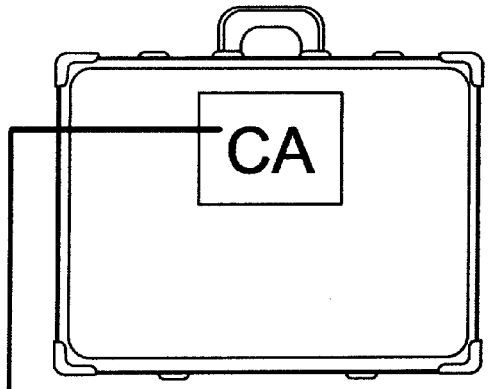
FIG. 30 is the initials of the board game of itself (Corporate Authority). The flap on FIG. 30 is down signifying that the piece does not have the ability to go backwards.
Figure 28:
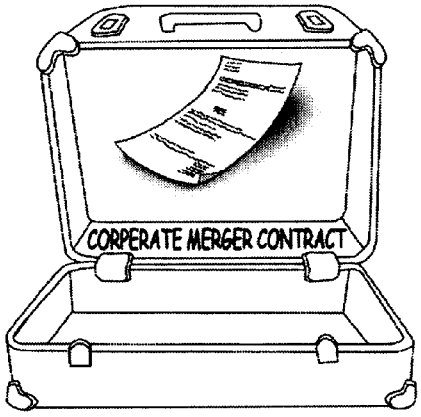
FIG. 28 is a perspective view of corporate merger contract brief case game piece.
Figure 31:
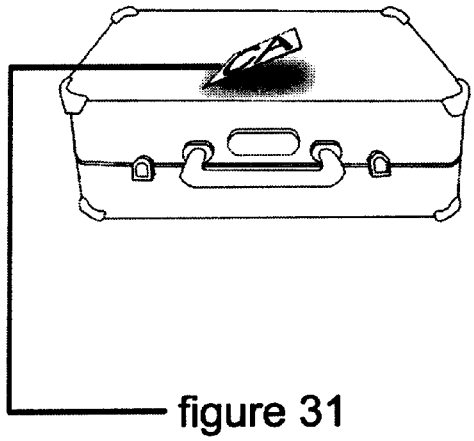
Figure 29:
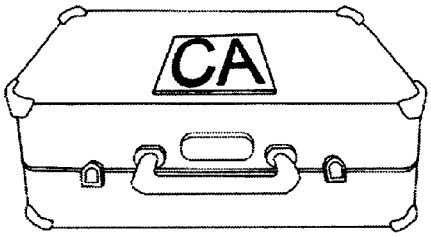
FIG. 29 is a closed brief case game piece.

The flap on FIG. 31 with the initials C.A is up signifying that the brief case game piece now has the ability to move backwards.

Figure 32:
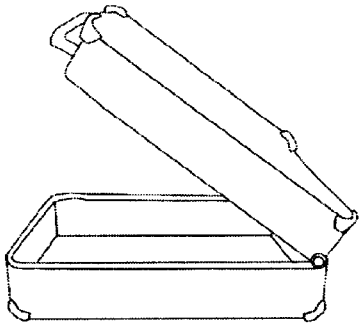

FIG. 32 is a side view of the brief case game piece.

Figure 33:
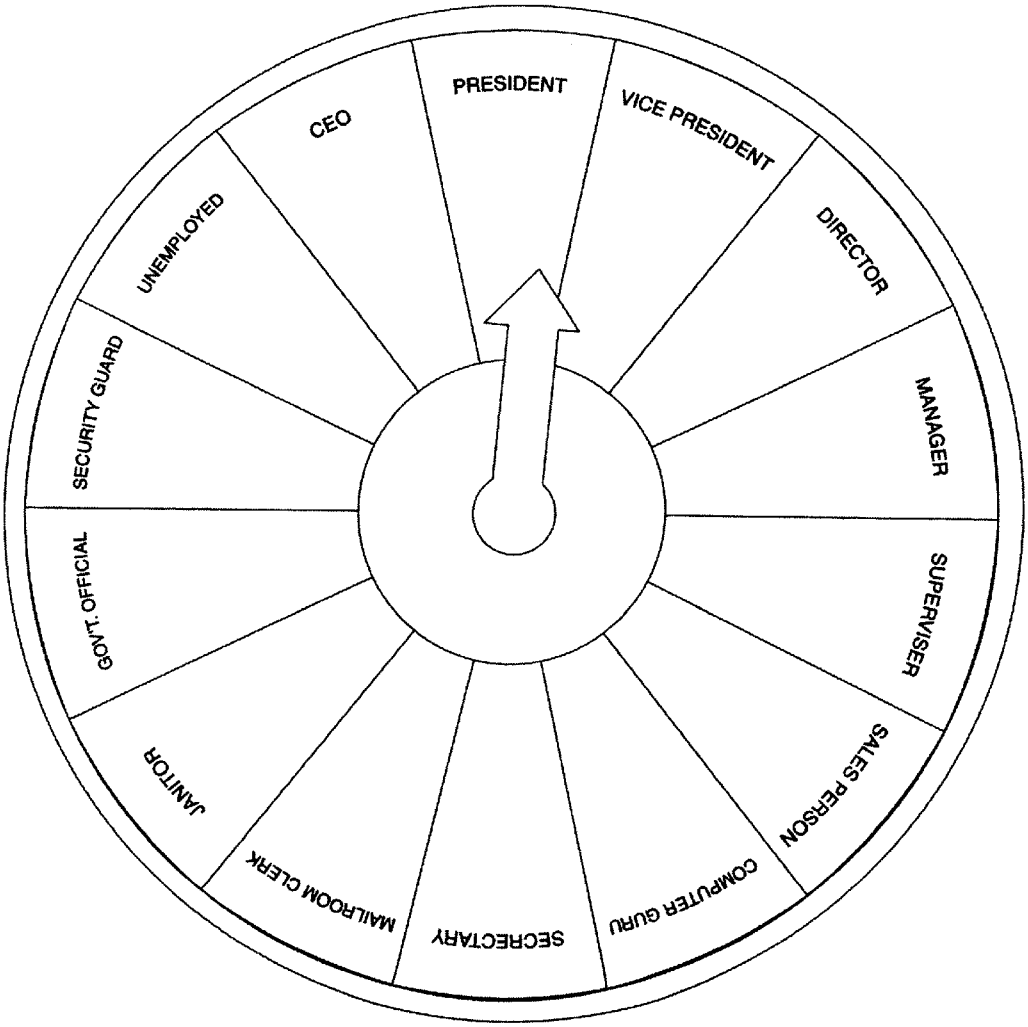

FIG. 33 is a perspective view of the wheel that is spun when private eye hacker attacks a game piece.

Figure 34:
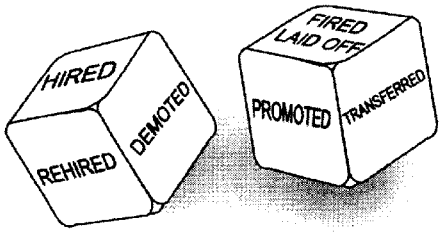

FIG. 34 is perspective views of the human resource dice. This dice is only thrown when a game piece attacks the human resource mystery piece.

Figure 36:
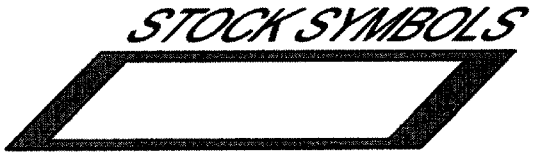
Figure 35:
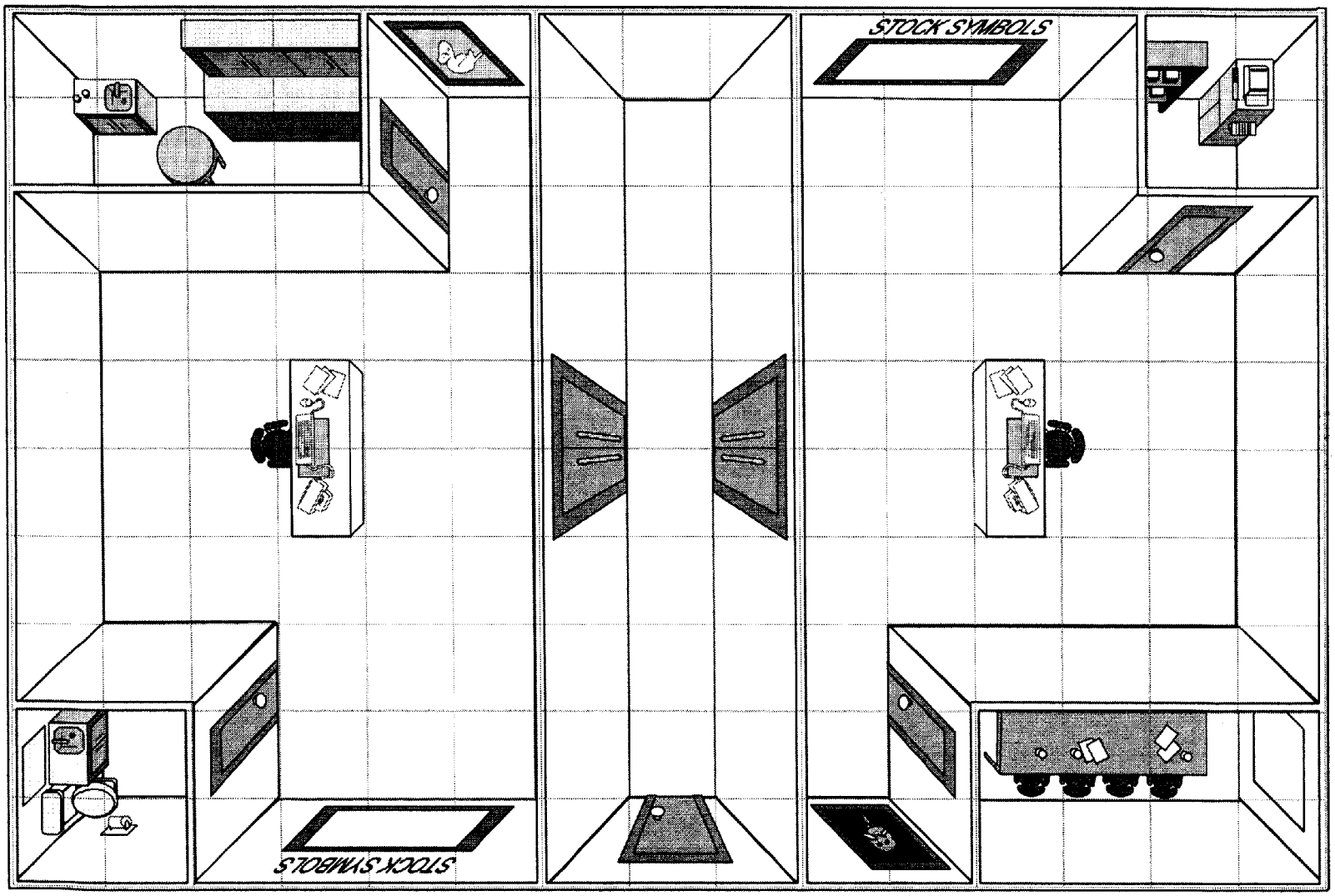

FIG. 35 is a perspective view of the Corporate Authority game board (the game board has 150 squares, but the squares can be changed to rectangles if chosen to do so). The stock symbols board (FIG. 36) on the game board is reserved for advertisers.

DETAILED DESCRIPTION OF THE INVENTION

The Story and Explanation of How and Why The Corporate Authority Board Game Came About As with any company or any workplace they all have some sort of rank and order positioning to define who's in charge. But what happens if there is a merger between two corporations. The first event that happens with almost all mergers are budget cuts, with workers as a result getting laid off or fired. The second event that happens when two companies merge is there could only be one CEO.

In this board game scenario, both CEO's are in fear of losing their jobs and decided to go against each other with their selected employees, in the battle to gain control of their respected company. Everything a person can think of in a corporate environment is involved within this game from a corporate ringer, to government official, to a Private eye hacker. For the CEO and his or her employees to win this game, keep their jobs and take control of their respected company they must apprehend their opponent's card key, find the corporate elevator and capture the corporate merger contract hidden on the game board (please be advised in the Corporate Authority board game the player must collect each special collectable piece in a specified order of card key, then corporate elevator, then corporate merger contract in executive conference room).

About the Game

The Corporate Authority is a two-player strategy game that is a hybrid combination of Checkers Chess, Stratego and Life. This board game is encompasses and challenges each player's memory, creativity, imagination, bravery, awareness, spontaneousness, discretion, educated guessing ability, critical thinking skills, decision making skills, and clever deception strategies.

In this game the game-board is your corporate office. Both rival companies (players) have a sleuth of employees at their disposal as well as various other obstacles that are commonly found in a corporate work place. Both players should cleverly arrange their 50 game pieces in the first five rows of ten facing them and hide their cardkey, corporate elevator, and corporate merger contract located in a executive conference room (each player has 55 pieces if you count the one brown nose piece, and the four out of the five make, up, name and draw pieces which can be included after the official game has started; these pieces will be explained in the special people pieces section).

The Corporate Authority board game is based on a per turn basis in which each player has one chance to move per turn. When a player moves into their competitor's rectangular space a corporate confrontation begins. When a player is one space away from their opponent they have the option to touch their opponents game piece and declare job titles to see who is of higher rank in the corporate office. The higher job position wins and the lower job position goes out of play. Having a corporate clash is"optional"; the attacking player has a choice not to have corporate conflict.

The game pieces that can be move; must move one single space at a time. Each game piece can move and attack in any direction (forward, side to side and diagonal) except backwards. The only time a game piece can move backwards is when it touches their opponent's last row of rectangular squares (the brown noser piece is the only piece that can always move backwards which will be later explained in the special people piece section chart below). To show and remind each player and their opponent that a game piece has the ability to move backwards; have the player's opponent pull the brief case's initials (C.A) up to signify the game piece is now allowed to move backwards. Each player in this board game has an identical number of different brief case game pieces. The identities of these brief case game piece's are only known to the player's owning them. There is a hierarchy of game pieces capable of apprehending a player's card key, their corporate elevator and the corporate merger contract. Each player must take their opponent's card key, find the elevator and locate the corporate merger contract to win the game; keep their job; and take control of their respected company. Please be advised in the game the player must collect each special collectable piece in a specified order of card key, then corporate elevator, and then corporate merger contract. A player may not collect the corporate merger contract game piece first. The only thing each player can do is memorize where they last saw the corporate merger contract game piece and collect the other two pieces (card key, and elevator) before they may capture that the corporate merger contract. The corporate merger contract game piece should be the last game piece collected. The first player to take these three special collectable pieces (in the order of such: card key, elevator, corporate merger contract) wins the game; keeps their job; and takes control of the company. Remember even though you are going after your opponents three special collectable pieces you also need to protect your own as well.

Ties of pieces result in both players still surviving and sharing corporate space together. As a player advances across the corporate game board they need be a strategic mastermind with a well thought out plan of attack. A keen memory, creativity, imagination, courage, caution, educated guessing, good decision making skills, clever deception and some luck may be helpful in this game as well.

One of the unique aspects of this board game that most board games in general lack is the aspect of creativity. In which each player has the ability to make up, name and draw their own game piece. Each player at the beginning of the game has the right to make, name and draw their own corporate game piece that hey think should be included in the corporate environment and call it whatever they want. The game piece can be anyone from a lawyer to an ex-professional wrestler. The only catch to this game piece, is that the piece each player made up themselves must lose to any two different people pieces set on the game board. For example, player 1 can say his lawyer he made up can only lose to the president and the security guard. Player 2 can say his ex-professional wrestler can only lose to the mailroom person and director. The make up, name and draw game piece will have a dry eraser board behind it (if a player would like they can replace the dry eraser board with a post-it or any other drawing surface). Please be advised in the game board box there will be five of these make up, name and draw pieces for each player. Only one of the five can be used at the start of the game (the other four make up, draw and name your game own pieces come into play only when an unemployed piece taps your opponents hired piece which will be later explained in the special piece chart in the make up, name and draw piece section).

Another aspect of this board game that is unique is the aspect of educated guessing. If a player can name at any time during the game what two consecutive pieces he will put out of play next, he will receive a special brown noser piece. This brown noser piece unlike any other piece on the corporate game board can move two spaces in any direction (the brown noser piece may not move just one space; it must move only by two spaces). The brown noser piece has the ability to also jump over pieces. The downside of the brown noser piece is that it can be beat by a supervisor piece or above (manager, director, vice president, or CEO).

A third unique aspect of this game is the aspect of a continuous changing piece. In the game this piece's name is called private eye hacker. Private eye hacker is a continuously changing chance game piece in which a person spins the wheel to see who this piece is this time when he or she is attacked or doing the attacking. Private eye hacker can temporarily be any people person when he is attacked (from a security guard, to a government official, or even the CEO). The spin of the wheel must be officially spun around at least 3 times in order for the spin to be allowed. There is no penalty if you fail to spin it less than three times. A person just merely needs to try to spin the wheel again.

Another special piece in this game is the government official. A government official can beat the three highest pieces on the game board (CEO, president and vice president) but can get killed by an unemployed person game piece. A government official can't be harmed by anyone except an unemployed person (the lowest ranked piece). Also let it be known a government official can't be put out of play by anyone director or below (manager, supervisor, sales, computer guru, secretary/operator, mailroom, or cleaners); nor can a director or below put a government official out of play.

A fifth unique aspect of this game is the security guard game piece that must be hit twice by a manager or above (this piece does not have to be hit twice consecutively). The security guard game piece can be hit twice by the same piece or by two different pieces; but they must be at manager level or above.

In addition to the game pieces just mention there are also seven unique obstacle pieces made up for this game. One of the seven unique pieces is called the hired piece. This piece only affects the unemployed piece. If an unemployed piece taps a hired piece the unemployed piece becomes a make up, name and draw piece. Unlike the make up, name and draw piece where the player themselves make up, name and draw their piece; these hired unemployed make up, name and draw pieces are made up by their opponent. Also unlike the first make up, name and draw game piece where the player can choose what two people pieces (special or regular) his or her game piece can lose to, the opponent this time chooses what two game pieces the player can lose to. After the unemployed piece gets hired they also must immediately be placed back in the first five rows of the player's side of the player's choosing (thus this is done so the player can't put the opposing player out of play on their next move). Please be advised if all of the unemployed pieces get hired then it may leave no possibility of putting the government officials out of play. But on the other hand what good is an unemployed piece if it can be destroyed by practically any people piece on the board. So this is a difficult decision that must be thought out by each player. This helps the player deal with critical thinking skills. Also, let it be known that if all the unemployed pieces get hire, the hired game piece goes out of play.

The fired game piece can fire any people piece (regular and special people pieces) from government official to the CEO. The only people piece it can't fire is the unemployed piece. Since the unemployed piece can't be fired for the simple fact that they are not employed. If the unemployed game piece attacks the fired piece the fired piece loses and goes out of play.

The demoted game piece demotes regular corporate people pieces one step down. For example, if the CEO hits this piece he becomes a president. For special pieces like the government official, security, brown noser, private eye hacker and/or make, name and draw your own piece, they become mailroom clerks automatically if they hit this particular piece. The cleaners/janitors or unemployed pieces are the only pieces that could put the demotion pieces out of play since they can't be demoted any lower. Please be advised that the same piece can't be demoted twice.

The promotion piece is the only one in the human resource category that can move but like the others it can't attack. This game piece only affects the regular people pieces, in which pieces can only be promoted one step up. Please be advised that the same piece may not be promoted twice; they must be different pieces. The Promotion piece has no effect on the special people pieces (such as brown noser, private eye hacker, security, make name and draw your own piece, and the government officials). The only game piece that could put the promotion game piece out of play is the CEO since this piece can't be promoted any higher.

The rehired piece can only be used once and its up to the attacker to decide what piece they want back. This rehired piece can't move or attack. The transferred piece can also only be used once. If the attacking player taps the transferred piece the attacking piece becomes property of their opponent, thus using there own piece against them. The transferred piece can't move or attack.

Last, but not least is the human resources mystery piece. With the human resources mystery piece the attacking player is taking a chance with his players status of being either hired, fired/laid off, promoted, demoted, rehired or transferred. A dice is thrown for the human resources mystery piece to find out this particular ruling. All of the Human resource obstacles can't move or attack (except the promotion piece which can move but can't attack). This piece can't be beat by any piece unless a player specifies it for their make up, name and draw game piece.

1) How to start the board game—Flip a coin (the winner decides whether he or she wants to go first or not).

2) How to set up the board game—After the coin flip. Each player should cleverly arrange their 50 game pieces in the first five rows in any fashion they would like. The brown noser piece (the 51$^{st}$ piece) stays in the display tray until a player can name during the game what two consecutive pieces of his or hers opponent piece's will put out of play next. In addition, before the start of the game, each player has the ability to make up, name and draw one game piece. This piece can be anyone from a lawyer to an ex-professional wrestler. The only catch to this game piece is that the piece each player made up themselves must lose to two different people pieces set on the game board. For example, player one can say his ex-wrestler can only lose to a security guard and a cleaner. Player two for example, can say his lawyer can only lose to the CEO and a government official. Furthermore, please note there will be four more draw, name and make your own game pieces but those four game pieces only come into the game if a player's unemployed piece touches their opponents hired piece.

3) The Two Ways a Person Can Play this Board Game

A) The first way players can play this board game is with their brief case game pieces opened. Wherein, each player can see their own game pieces but their opponent cannot.

B) The second way players can play this board game is after each player cleverly arranges their game pieces both players can close their brief case game pieces. Wherein, both the player as well as their opponent can't see the game pieces, thus forcing both players to increase their memorization skills.

The Contents of the Game (Equipment)

A) One game-board (can be either hard or soft material). If the players are using the soft game board edition they can fit the game board itself in their pocket. The game board will have one hundred and fifty rectangular spaces and will look like a corporate office with cartoon like characters involved.

B) Instructions will be in different languages.

C) Two corporate headquarter covers.

D) One spinning wheel (for private eye hacker, when he is attacked or doing the attacking).

E) One human resource mystery dice (used when a player attacks the human resource mystery piece).

F) Each player has fifty-five, glow in the dark brief case plastic game pieces (the one brown nose piece and the four of the five make up, name and draw your own game pieces are not used at the beginning of the game).

G) A VCR videotape as well as a website video=teaching players how to play the game. The Website will also have listings of tournaments around the world about where the Corporate Authority will be played.

H) An erasable marker for the dry eraser board on the make up, name and draw game pieces (if a player runs out of markers to draw on the dry eraser board; they can use pens instead to draw on a post-it or any other drawing material).

What Each of the different Pieces Do; The Number of Pieces per Job Title Each Player has; and the Advantages and Disadvantages of Each Piece in the Game:

Regular Corporate People Piece Chart

| Job Position | Number of Pieces | What each piece does; advantages and disadvantages of each piece |
|---|---|---|
| CEO (Chief Executive Officer) | 1 | This is the highest ranked piece in the board game. The CEO is the only game piece that can put the promotion game piece out of play since it's the highest piece already in the game and it can't be promoted any higher. Also let it be known the only game pieces that can put the CEO out of play is, the government official and/or the fired piece |
| President | 1 | This is the 2nd highest ranked piece in the board game. The president can be beat by the CEO, a government official or the fired piece. |
| Vice President | 1 | This is the third highest ranked piece in the board game. The vice president can be beat by the CEO, president, government official or the fired piece |
| Director | 1 | *****This is the 4th highest ranked piece in the board game. The Director can be beat by the CEO, president, vice president or the fired piece. The director piece and down can't be destroyed by the government official nor can a director or down destroy a government official. |
| Manager | 2 | *****This is the 5thhighest ranked piece in the board game. The manager can be beat by the CEO, president, vice president, director or the fired piece. |
| Supervisor | 3 | *****This is the 6th highest ranked piece in the board game. The supervisor can be beat by the CEO, president, vice president, director, manager or the fired piece. |

-continued

Regular Corporate People Piece Chart

| Job Position | Number of Pieces | What each piece does; advantages and disadvantages of each piece |
|---|---|---|
| Sales Person | 3 | *****This is the 7th highest ranked piece in the board game. The sales person can be beat by the CEO, president, vice president, director, manager, supervisor or the fired piece. |
| Computer Guru | 3 | *****This is the 8th highest ranked piece in the board game. The computer guru can be beat by the CEO, president, vice president, director, manager, supervisor, sales or the fired piece. |
| Secretary/ Operator | 4 | *****This is the 9th highest ranked in the board game. This piece can be beat by the CEO, President, vice president, director, manager, supervisor, sales, computer guru or the fired piece. |
| Mailroom Clerk | 5 | *****This is the 10th highest ranked piece in the board game. Mailroom clerks can be beat by the CEO, president, vice president, director, manager, supervisor, sales, computer guru, secretary/operator or the fired piece. If any of the special people pieces (government official, security, brown noser, private eye hacker and/or make, name and draw your own piece) touch the demoted game piece they become mailroom clerks automatically. |
| Cleaner/ Janitor | 6 | *****This is the lowest ranked corporate people piece on the game board. It can be beat by the CEO, president, vice president, director, manager, supervisor, sales, computer guru, secretary/operator, mailroom or the fired piece. The only game pieces the cleaners/janitors can beat are the unemployed pieces and/or the demoted piece (the reason why this piece can put the demotion piece out of play is because it can't be demoted any lower). |

*****The director and down (manager, supervisor, sales, computer guru, secretary/operator, mailroom, and cleaners) can't be destroyed by the government official; nor can a director or down destroy a government official.

****All people pieces (regular or special) can beat the unemployed piece except the government official piece.

***Ties of game pieces result in both players still surviving and sharing corporate space together (the limit for the same pieces to share the same corporate space together is four).

**All people pieces (regular or special) can be fired by the fired piece (the only exception is the unemployed piece since it can't be fired because it is not employed).

*The make up, draw and name pieces (discussed in the special people piece chart) have the ability to beat any piece on the game board (even the CEO), if a player specifies it.

Special People Piece Chart

| Job Position | Number of Pieces | What each piece does; advantages and disadvantages of each piece |
|---|---|---|
| Make up, name and draw your own game (Ringer) | One is used at the start of the game; and the other four can be used after the game starts if the unemployed piece taps the hired piece (the make up name and draw piece replaces the unemployed | Both players have the ability to make up, name and draw their own game piece. This piece can be anyone from a lawyer to an ex-professional wrestler. The only catch to this game piece is that the piece each player made up themselves must lose to two different people pieces set on the game board. For example, player one can say his ex-professional wrestler can only lose to a security guard and a cleaner. Player two for example, can say his lawyer can only lose to the CEO and a government official. In addition, there are 4 more make up, name and draw pieces but they come into play after the game has started if and only if an unemployed piece taps a hired piece. The difference between the hired unemployed |

-continued

Special People Piece Chart

| Job Position | Number of Pieces | What each piece does; advantages and disadvantages of each piece |
|---|---|---|
| | piece after it is hired). | pieces and the first make up, draw and name piece is that your opponent instead of the player makes up, draws and names your pieces. The opponent unlike the first make up, draw and name piece also makes up what two pieces your hired unemployed piece can be beat by. After the unemployed piece gets hired they also must immediately be placed back in one of the first five rows of the player's side of the player's choosing (thus this is done so the opposing player can't put the attacking player out of play on their next move). Please be advised if all of the unemployed pieces get hired then it may leave no possibility of putting the government officials out of play. But on the other hand what good is an unemployed piece if it can be destroyed by practically any people piece on the board. |
| Government Official | 2 | A government official can beat the three highest pieces on the game board (CEO, president and vice president). However, a government official can be put out of play by a angry unemployed person or a fired obstacle piece. A government official can't be harmed by any people piece except an unemployed person piece. Also let it be known a government official can not be put out of play by anyone director status or below; nor can a game piece director status or below put the government official out of play. |
| Brown Noser | 1 | A brown noser piece is not arranged on the game board at the beginning of the game. The brown noser piece only comes into play, if a player can name at any time during the game what two consecutive pieces he will put out of play next. This brown noser piece unlike any other piece on the game board can move two spaces in any direction (but the spaces must be in the same direction). The brown noser piece also has the ability to jump over pieces. The downside of the brown noser piece is that it can be beat by a supervisor piece or above (manager, director, vice president, or CEO). Also please note a brown noser piece is not allowed to move one space at a time; the brown noser piece can only move two spaces at a time in any direction (but the two spaces must be in the same direction |
| Private Eye Hacker | 1 | This is a continuing changing chance people piece. Every time this piece attacked or is doing the attacking, a spin of the wheel must be made to see what piece it is temporarily posing as at this particular point in time. This piece can be any regular or special people piece (government official, security guard, unemployed, brown noser). |
| Security Guard | 2 | Can be beat by manager or above; but this piece must be hit twice (please note, that this piece does not have to be hit twice consecutively). It can be hit twice by the same piece or by two different pieces; but they must be at manager or above status. |

-continued

Special People Piece Chart

| Job Position | Number of Pieces | What each piece does; advantages and disadvantages of each piece |
|---|---|---|
| Unemployed | 4 | This is the only piece that could beat the government official. However this piece can lose to any other people piece on the game board; even the cleaners/janitors. This piece has the option of getting hired by the hired piece; but be careful remember this is the only piece that could put the government officials out of play. This piece can't be fired and not only can it not be fired, but the unemployed piece also can put the fired piece out of play. Please look at the make up, name and draw piece section to see what happens when an unemployed piece taps a hired piece. |

****The Fired piece can fire any regular corporate people piece or special people piece (except the unemployed piece).
***If two make up, name and draw pieces attack each other it's considered a tie and therefore they can share the corporate space together.
**The make up, draw and name game piece has the capability of beating the CEO piece if each player desires it to.
*All pieces that are capable of moving can move in any direction except backwards. The only way moving game pieces are able to move backwards is if they touch their opponents last row of rectangular squares (the only exception game piece for moving backwards at all times is the brown noser piece).

Human Resource Obstacle

| Human Resource Obstacles | Number of Pieces | What each piece does; advantages and disadvantages of each piece |
|---|---|---|
| Hired | 1 | This piece is only good for the four unemployed pieces. When an unemployed piece taps the hired piece it becomes a make up, name and draw game piece. But unlike the make up name and draw piece at the beginning of the game where the player themselves make up, draws and names their piece; the opponent makes up, draws and names your piece. Also unlike the beginning make up, draw and name piece where each player decides what two pieces they could get beat by, the opponent decides what two pieces your hired unemployed piece can be beat by. Please be advised once the unemployed piece gets hired they must report back to one of the rectangular spaces in the first five rows facing the attacking player (thus this is done so the opposing player can't put the attacking player out of play on their next move). Also, let it be known that the only way for the hired piece to be put out of play is for all the unemployed pieces to get hired. |
| Fired/ Laid off | 1 | Any of the people pieces (regular or special) can be fired from CEO, to a Government official. This piece can't move nor attack. The only game piece that can't be fired or laid-off is the unemployed game piece. The unemployed piece also puts the opponents fired piece out of play. |
| Promoted | 1 | The promotion piece is the only one in the human resource category that can move but like the others it can't attack. This piece only affects regular people pieces in which pieces can only be promoted one step up. Please be advised that the same piece may not be promoted twice they must be different pieces. The Promotion piece has no effect on the CEO since it's the highest piece on the board already; and if the CEO touches the promotion piece, the promotion piece goes out of play. Also the promotion piece doesn't have any effect on the special pieces (such as brown noser, |

-continued

Human Resource Obstacle

| Human Resource Obstacles | Number of Pieces | What each piece does; advantages and disadvantages of each piece |
|---|---|---|
| | | private eye hacker, security, make, name and draw your own piece, and the government official). This piece can move but can't attack. |
| Demoted | 1 | The demoted piece demotes people pieces one step down (except for the special people pieces). For example if the CEO hits this piece he becomes a president. For special pieces like the government official, security, brown noser, and private eye hacker, and make, name and draw your own piece they become mailroom clerks automatically if they hit the demoted game piece. If the cleaners or the unemployed touch the demotion piece, the demotion piece goes out of play. Let it also be known that no one piece can be demoted twice. This piece can't move nor attack. |
| Transfer | 1 | The transferred piece can only be used once. If the attacking player taps this piece the piece becomes property of their opponents thus using there own game piece against them. This piece can't move or attack. |
| Rehired | 1 | The rehired piece can only be used once and its up to the player tapping the rehired piece to decide what piece they want back. This piece can't move or attack. |
| Human Resource Mystery Piece | 1 | With this piece you never know if your going to be hired, fired, promoted, demoted, rehired or laid-off. A dice is thrown for this piece to see where your piece stands. Every time you hit this piece you never know what you are going to get. |

Special Collectable Pieces

| Special collectable pieces | Number of pieces | The specified order in which each player must capture each game piece |
|---|---|---|
| Card Key | 1 | The card key must be capture first. The card key is allowed to move but is defenseless. This piece can't attack. |
| Corporate Elevator | 1 | The corporate elevator must be found second. This piece can't move or attack |
| Corporate Merger Contract | 1 | The corporate merger contract must be apprehended last. This piece can't move or attack. |

Object of the Game

Each player must take their opponent's card key, find the elevator and locate the corporate merger contract to win the game; keep their job; and take control of their respected company. Please be advised in the game the player must collect each special collectable piece in a specified order of card key, then corporate elevator, and then corporate merger contract. A player may not collect the corporate merger contract first. The only thing each player can do is memorize where they last saw the corporate merger contract and collect the other two game pieces (card key, and elevator) before they may capture that the corporate merger contract game piece. The corporate merger contract game piece should be the last game piece collected Some Additional Rules of the Game 1) Each player can only move one piece at a time.

2) Each piece that is capable of moving, may move one space at a time in any direction they want, (forward, diagonal or sideways) except backwards. The only way a game piece can move backwards is if it touches their opponent last row of rectangular squares. When and if a people game piece does touch the last row of their opponent's rectangular squares the opponent must pull the brief cases initials (C.A) up to signify the game piece is now allowed to move backwards (please be advised that these rules don't pertain to the brown noser piece).

3) The brown noser piece can move two spaces at a time, but "may not" move one space at a time. The brown noser piece also unlike other moveable pieces is always allowed to move backwards, even if the brown noser game piece did not touch their opponents back row of rectangular squares.

4) Game piece movement is simplified by one unit per space, per turn rules (except the brown noser piece which can move two spaces instead of one; brown noser pieces are also allowed to jump over pieces). The two spaces a brown noser may use have to be in the same direction.

5) The brown noser piece is to remain out of play in the beginning of the game. The only way a player can get a official brown noser piece in the game is when a player can guess what two consecutive game pieces of his or her opponent is he or she going to put out of play next. There is only one official brown noser piece allowed on each side. Each player can get a brown noser piece at any point during the game but they have to guess correctly and tell their opponent what two pieces they are going to destroy consecutively.

6) A total amount of four pieces can share the same corporate rectangular space but only if they are of the same rank.

7) If any of the players can't move their pieces they lose.

8) The card key piece is allowed to move but can't attack.

9) The corporate elevator and the corporate merger contact in the executive conference room can't move or attack.

10) Don't show each other pieces to each other unless attacked.

11) These pieces don't move: Hired piece, fired piece, demotion piece, rehired piece, transfer, corporate elevator, corporate merger contract and the human resources mystery piece (the promotion piece is the only human resources obstacle game piece that can move; and the card key is the only special collectable game piece that can move).

12) If the attacker wins he goes to your space; if the defender he stays in his place (attacking a game piece is optional).

13) Game pieces can't jump over opponent pieces (the brown noser game piece is the only piece allowed to jump over pieces).

14) The unemployed game piece is not effected by the demotion piece or fired piece, unless the unemployed piece gets employed by the hired piece.

15) Unemployed pieces need to find the hired pieces. Regular pieces are not affected by hired pieces in any way shape or form. Be careful with the unemployed pieces because they are the only ones that can destroy your Government official.

16) You can't get promoted higher than CEO in this game

17) The promotion piece is the only human resource piece that can move. The promotion piece can't attack.

18) The rehired piece can only be used once; after the rehired game piece is used it is taken out of the game. If a player touches this piece and the attacking player has not lost a piece yet, the rehired piece still goes out of play.

19) Who the Human resource obstacles can be taken out of play by:

a) Demotion Piece=cleaners and unemployed b) Promotion Piece=CEO c) Fired/Laid Off=unemployed d) *Hired=If all unemployed pieces get hired then the hired game piece goes out of play.

e) *Transferred and Rehired=both game pieces can only be used once

20) Players are not allowed to move back and forth on the same two spaces more than "four" consecutive times.

Strategies

1) A player can sacrifice low ranked pieces to discover what pieces their opponent is using.

2) Players can protect their card key piece, corporate elevator piece and corporate merger contract game piece with high ranked pieces.

3) Players should not rush with their high ranked pieces

4) Each player should have a well thought out plan of attack

5) Once players see some pieces move they can begin to have an idea what pieces are what.

6) Players should not let their guard down and always be aware of their opponent's moves.

I claim:

1. A Method of playing a corporate two-player hide and attack, scavenger hunt strategy board game that functions and configurations comprises the steps of:

a) providing a corporate game piece having a blank marketable dry eraser board, providing an erasable marker and drawing a character on a corporate game piece by the use said erasable marker;

b) providing a game piece of chance that has the ability to continuously change it's type or name temporarily, if the game piece is attacked, meaning challenged by their opponent's game piece for capture when the opponent's game piece is one space away and lands on the opposing player's space to declare job title ranks or is doing the attacking, meaning challenging their opponent's game piece for capture when the game piece is one space away and lands on their opponent's space to declare job title ranks;

c) providing a game piece structure that is introduced into the game after the game has started by the process of educated guessing, in which a player has to name and call out to their opponent the two game pieces they will defeat consecutively for a player to get a new game piece included into the game d) providing a game piece structure that must be challenged by their opponent's game piece for capture twice, when the opponent's game piece is one space away and lands on the opposing players space twice by a specified higher ranking game piece or above of their opponent, in order to be put out of play;

e) providing a game piece in which, if any game piece structure challenges their opponent's transferred game piece for capture when the opponent's game piece is one space away and lands on the opposing player's space of where the transferred game piece is placed, the challenging game piece's ownership that challenged the transferred game piece gets exchanged from the challenging player to their opponent, thus using the player's original game piece against the original owner f) providing a game piece structure that could promote or demote a game piece's rank g) providing a game piece structure that could bring a new game piece structure into the game h) providing game piece structures that are cleverly arranged and not fixed;

i) providing a plurality of corporate game pieces structures inside and outside the corporate environment that have different distinguishing characteristics such as:

I) at least one CEO game piece;

II) at least one president game piece;

III) at least one vice president game piece;

IV) at least one director game piece;

V) at least one brown noser game piece;

VI) at least one private eye hacker game piece;

VII) at least one hired game piece;

VIII) at least one promotion game piece;

IX) at least one demotion game piece;

X) at least one transferred game piece;

XI) at least one rehired game piece;

XII) at least one fired/laid off piece;

XIII) at least one human resource mystery game piece;

XIV) at least one card key game piece;

XV) at least one corporate elevator game piece;

XVI) at least one corporate merger contract game piece;

XVII) at least one six sided dice wherein each side represents a human resource obstacle of either being hired, fired/laid off, promoted, demoted, rehired or transferred;

XVIII) a plurality of manager game pieces;

XIX) a plurality of supervisor game pieces;

XX) a plurality of sales person game pieces;

XXI) a plurality of computer guru game pieces;

XXII) a plurality of secretary/operator game pieces;

XXIII) a plurality of mailroom clerk game pieces;

XXIV) a plurality of cleaner/janitor game pieces;

XXV) a plurality of naming, drawing, and creating game pieces structures that a person's opponent specifies and creates;

XXVI) a plurality of government official game pieces;

XXVII) a plurality of security guard game pieces;

XXVIII) a plurality of unemployed game pieces.

2. A method of playing the board game recited in claim 1 further comprising of the steps of:

a) providing a board game wherein each player in their method of play must acquire and capture their opponent's three predetermined game pieces in which one of the game pieces is moveable, meaning that this game piece is allowed to move around the game board and the other two game pieces of which are unmovable, meaning that these game pieces are not allowed to move around the game board and must stay in the space they were placed in, wherein when said game pieces are to be captured in the order comprising of:

I) the card key being the first predetermined game piece captured;

II) the corporate elevator being the second predetermined game piece captured;

III) the corporate merger contract being the third predetermined game piece captured;

b) said board game wherein the game pieces can be made of any material and resemble any office product;

c) said board game whereby a variety of substances that make up a horizontal playing surface;

d) said game board having indicia resembling a corporate office with cartoon character game pieces included;

e) said board game wherein the game can be played electronically by two different players or by one player against a virtual computer;

f) said board game having spaces for businesses to advertise their business.

3. Game piece structures that have the function of being hidden from both their opponent and the player themselves comprising of:

a) a plurality of game pieces with each game piece having the shape of a closeable brief case or any other type of closing structure, each game piece having indicia inside the closeable brief case uniquely identifying each game piece from all the other game pieces, wherein when said game pieces are closed that identity of each game piece is hidden b) each game piece having a compartment therein for placing any object inside the game piece.

* * * * *